United States Patent [19]

Rabinowitz

[11] 4,119,793

[45] Oct. 10, 1978

[54] TRANSMISSION LINE BREAKDOWN VOLTAGE

[75] Inventor: Mario Rabinowitz, Menlo Park, Calif.

[73] Assignee: Electric Power Research Institute, Inc., Palo Alto, Calif.

[21] Appl. No.: 680,261

[22] Filed: Apr. 26, 1976

[51] Int. Cl.[2] ..... H01B 9/02

[52] U.S. Cl. ..... 174/36; 174/115

[58] Field of Search ..... 174/36, 115, 113 R; 178/45, 46

[56] References Cited

U.S. PATENT DOCUMENTS

| | | | |
|---|---|---|---|
| 3,492,622 | 1/1970 | Hayashi et al. | 174/36 |
| 3,683,309 | 8/1972 | Hirose | 174/36 |

FOREIGN PATENT DOCUMENTS

| | | | |
|---|---|---|---|
| 491,987 | 2/1930 | Fed. Rep. of Germany | 174/36 |
| 2,101,046 | 7/1973 | Fed. Rep. of Germany | 174/36 |
| 1,280,667 | 11/1961 | France | 174/36 |

*Primary Examiner*—Arthur T. Grimley
*Attorney, Agent, or Firm*—Townsend and Townsend

[57] ABSTRACT

Improved transmission line voltage breakdown strength is achieved by applying magnetic fields in transmission lines. In colinear transmission lines, particularly coaxial cables, one means of magnetic field introduction is accomplished by applying an axial magnetic field about the transmission line, which together with the self-induced power current magnetic field creates a net helical magnetic field whose pitch is dependent upon the relative magnitudes of the azimuthal component of the self-induced magnetic field and the axial component of the applied magnetic field. The applied magnetic field may be achieved by a permanent field or by directing either an alternating current or direct current through a helical winding defining a solenoid coaxial with the transmission cable. Alternatively, the applied field may be achieved by surrounding the grounded sheath with oriented ferrite or other magnetic material in a suitable support medium such as a pliable plastic bond form to produce a multipole magnetic field.

19 Claims, 5 Drawing Figures

FIG. 1
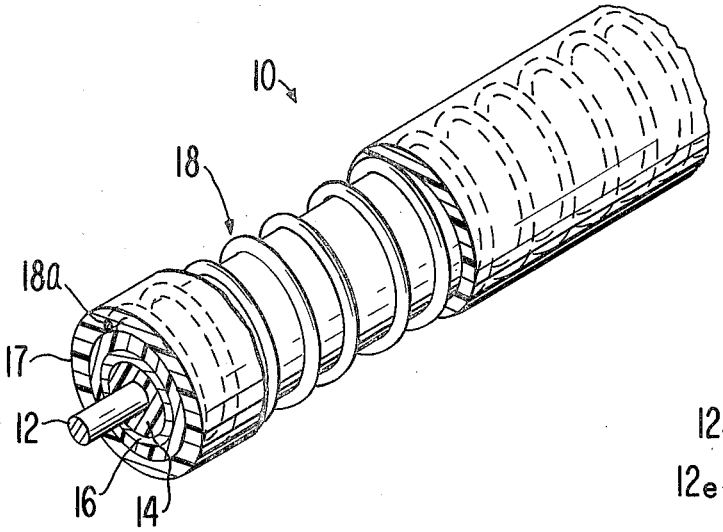
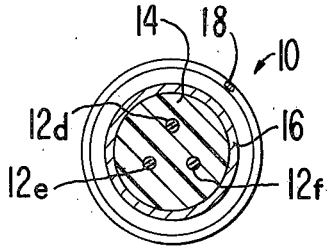
FIG. 5
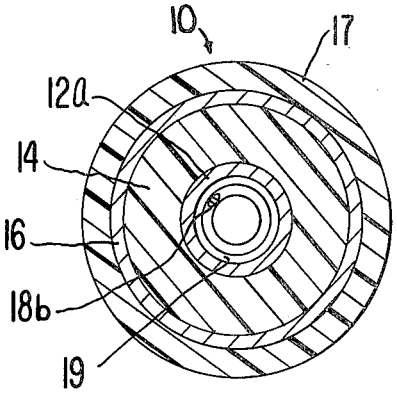
FIG. 2
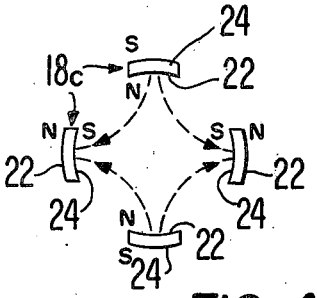
FIG. 4
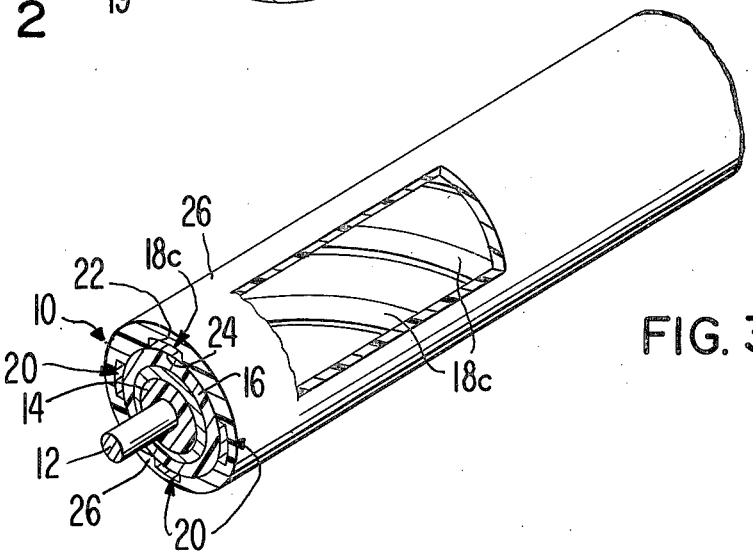
FIG. 3

TRANSMISSION LINE BREAKDOWN VOLTAGE

BACKGROUND OF THE INVENTION

This invention was made under contract with or supported by the Electric Power Research Institute.

Field of the Invention

This invention relates to high voltage transmission lines and particularly to high voltage transmission lines having improved voltage breakdown strength.

Various transmission line technologies including $SF_6$, respective cryogenic, and superconducting techniques suffer from the inability to meet the voltage breakdown strength requirements for high voltage power transmission. Electrical breakdown in a medium is caused by an avalanche of charged particles resulting in a disruptive discharge through or over the insulative medium. In order for there to be a high probability of ionizing an atom or molecule with which a charged particle such as an accelerated electron collides, the charged particle must have an energy corresponding roughly to the maximum ionization cross section of the atom or molecule, which is typically about ten times the threshold ionization energy. If ionization occurs upon collision, two electrons become available to continue the process, causing electron multiplication or avalanche. By affording means which minimize the probability of an electron achieving the energy level corresponding to the maximum ionization cross section, and interfering with the attainment of a conducting path between the conductors, an increase in breakdown voltage can be achieved.

Coaxial transmission cables comprising an inner conductor and a grounded concentric shield separated by a dielectric medium are typically utilized for underground high voltage power transmission. Shielded multiple conductor colinear power cables are also known. The invention is generally applicable to the colinear case, also, although for convenience, discussion will generally be limited to the coaxial case.

In a coaxial cable, the electric field is radial between the inner conductor and the concentric outer sheath, and the self-magnetic field is azimuthal, that is, concentric with the inner conductor. A breakdown condition will result if the electric field strength is sufficient to cause breakdown in the dielectric medium. A dielectric medium or insulation material exhibits a characteristic breakdown voltage threshold level at a given thickness. One conventional technique for increasing the voltage breakdown level of a coaxial cable is to increase the thickness of the dielectric medium and therefore the separation of the inner conductor and the outer sheath. However, the voltage breakdown level of any kind of insulation does not increase at a rate equal to the increase in total insulation thickness. Therefore, as operating voltages increase, the required thickness of the insulation material must be greatly increased to potentially exhorbitant, uneconomical and extremely cumbersome cable size. A need therefore exists to achieve relatively high voltage transmission while minimizing the probability of voltage breakdown resulting from the high self electric field.

Description of the Prior Art

Transmission lines having helical or like outer conductors are known for diminishing the corona losses of a transmission system. Prima facie the configuration may appear to be similar to the present invention, but in fact the method of operation and objects are readily distinguished. U.S. Pat. No. 2,009,854 discloses a current-carrying conductor system having a helical outer conductor or a gauze connected to the inner conductor for reducing the electric fields associated therewith, the express objective of the helix or gauze being to do so with minimum weight penalty.

The potential use of a high permeability material in the helix is recognized for the purpose of increasing the inductance of the transmission line. A reference showing helical windings and high permeability material of low Curie temperature about the electrical conductors in the form of a shorted secondary turn is U.S. Pat. No. 3,316,345. The object of that invention is to increase power dissipation in the helix when the temperature is below 0° C. in order to prevent ice formation.

British Pat. No. 639,040 provides a helix electrically connected to the current carrying conductor, similar to U.S. Pat. No. 2,009,854 above, providing an electrical screen. That invention does not suggest the use of a helix to provide a magnetic field.

German Offenlegungsschrift No. 1,665,389 discloses a method for establishing a permanent magnetic field around and along a high voltage overhead line with permanently magnetized wires or strands sheathed within the core of the inner conductor. The express object is to reduce corona losses and displacement current phenomena in the outer conductor and to suppress effects due to voltage transients. This German reference is vague as to the configuration of the magnetic field to be provided, as well as its magnitude and method for practicing its teaching. Moreover, this reference fails to recognize the cause and cure of the dielectric voltage breakdown phenomena.

SUMMARY OF THE INVENTION

By applying axial and/or multipole magnetic fields to a transmission line, particularly to an underground coaxial cable, improved voltage breakdown strength is achieved. In coaxial cables, this is accomplished by introducing a magnetic field about the transmission line which together with the self-induced power current magnetic field causes a net helical drift of charged particles. In one embodiment, this comprises an applied axial magnetic field which interacts with the self-induced azimuthal magnetic field to provide a net helical field whose pitch depends upon the relative magnitude of the azimuthal component of the selfmagnetic field and the axial component of the applied magnetic field. The applied axial magnetic field may be produced by providing a current through a helical solenoid winding external of the dielectric medium of the cable, either outside of the outer conductor or within the core of an inner conductor of the cable. Preferably the energy source for the magnetic field is energized separately from the power cable. Alternatively an applied multipole field may be provided by surrounding the grounded sheath with suitably oriented magnetic material in a suitable support medium such as a flexible plastic bonded form.

A time-varying applied magnetic field utilizing available 60 Hz power may be used. Alternatively, direct current may be utilized to energize the helical winding.

In a further embodiment a spiral multipole magnetic field may be provided coaxial to the conductor which is operative to focus charged particles such as electrons away from the sheath thereby to deter voltage breakdown.

BRIEF DESCRIPTION OF THE DRAWINGS

The invention may be more fully understood by reference to the following detailed description of specific embodiments, together with the accompanying drawings in which:

FIG. 1 depicts in cross section and partial cutaway a first embodiment of the invention;

FIG. 2 illustrates a cross section of a second embodiment of the invention;

FIG. 3 depicts in perspective cross section and partial cut away a third embodiment of the invention;

FIG. 4 is a schematic cross section of a multipole configuration according to an embodiment of the invention; and FIG. 5 is a cross section of a further embodiment illustrating a colinear cable.

DETAILED DESCRIPTION OF THE SPECIFIC EMBODIMENTS

A cable 10 constructed and operable according to the invention, is suitable for underground high voltage power transmission. Various embodiments are depicted in FIGS. 1 through 5. The cable 10 comprises essentially an inner conductor 12, a dielectric 14, a surrounding outer conductor 16, a protective sheath material 17 covering the outer conductor 16, and a means 18 applying a magnetic field in the dielectric 14. It is to be understood throughout, that the dielectric 14 herein refers to any relatively nonconductive feature including a solid, a liquid, a gas, a vacuum or combinations thereof comprising an insulative region or medium.

According to the invention the magnetic field applying means produces a magnetic field which vectorially adds to the self-magnetic field to create a helical drift of charged particles in the dielectric 14 away from their point of origin, thereby inhibiting their tendency to completely traverse the gap between the coaxial conductors 12 and 16 in a manner resulting in voltage breakdown.

As hereinafter illustrated, the magnetic field applying means 18 may be provided in various geometries, all of which are external of the dielectric 14, that is, not between the inner conductor 12 and the outer conductor 16. Furthermore, the magnetic field applying means 18 is not inductively energized through the conductors 12 and 16. That is to say, the field applying means 18 is either permanent magnet means or is energized separately from the power carrying conductors 12 and 16. For example, the field applying means 18, if requiring a current to apply a magnetic field, may derive that current from an isolated power source, or from the power source common to the transmission line, or by direct connection to the power carrying conductors 12 and 16 only at selected points along the line. It is generally preferable and convenient to energize the field applying means 18 by the power source common to the transmission line. By this means additional power is not required, and difficulties are avoided which are associated with distributed parameter voltage divisions caused by the difference in impedances between conductors 12 and 16 and the field applying means 18.

In FIG. 1, illustrating the coaxial cable 10, the magnetic field applying means 18 comprises a helical solenoid winding 18*a* wound coaxially about the outside of the outer conductor 16. In a coaxial cable, the electric field is radial between the inner conductor 12 and the outer sheath 16. The self-magnetic field is azimuthal, concentric with the inner conductor. The application of an axial magnetic field gives a net helical field whose pitch depends on the relative magnitudes of the azimuthal and axial components. Although the cable carries a sizable current, the self-magnetic field is not always very large at its maximum value at the surface of the inner conductor, and always decreases rapidly in the radial direction, as it is inversely proportional to the radius. A current applied through the solenoid 18*a* imposes such an axial magnetic field within the solenoid core coaxial to the dielectric 14 which adds vectorially with the self (azimuthal) magnetic field of the conductor 12, producing what is most easily visualized as a helical magnetic field. The pitch of the resultant net helical field is dependent upon the direction and relative magnitude of the azimuthal magnetic field and the axial magnetic field since the resultant field is the vector sum of the two fields. The magnitude of the axial field is a function of current applied through the solenoid 18*a*. As a consequence of the applied azimuthal field, free charge carriers in the dielectric 14 tend to drift in a helical path, inhibiting charge carrier motion in the direction of the electric field. Thus the charge carriers are less susceptible to conditions which would cause an avalanche, particularly by dispersing the charge associated with localized corona, thereby suppressing conditions for the onset of breakdown.

By way of example, an $SF_6$ gas dielectric cable having a dielectric core of approximately 12.7 cm inner diameter and approximately 38.1 cm outer diameter carrying 3000 Amperes at 345 kV (phase to phase) produces a maximum electric field of about $3 \times 10^4$ V/cm and a maximum power current or self-magnetic field of only about 94 Oe. By application of a small (i.e. of the same order as the self field) axial magnetic field, readily obtainable by a concentric solenoid carrying a relatively small current, a spiral drift of charged particles in the dielectric results, which tends to impede the particles from reaching the conductors, propagating the particles roughly in the axial direction.

Consider the simple situation where a charged particle of charge q and rest mass m ideally traverses the gap between conductors without collisions (i.e. in a vacuum). The approximate magnitude of minimum applied axial magnetic flux density required to prevent the charged particle from crossing the gap, when the particle is emitted from the inner conductor, (typically when the inner conductor is negative with respect to the outer conductor), is given by the expression:

$$B \geqq \frac{2r_2}{(r_2^2 - r_1^2)} \left[ \frac{2mV}{|q|} \left( 1 + \frac{|q|V}{2mc^2} \right) \right]^{\frac{1}{2}} + \frac{2mv_0 r_1}{q(r_2^2 - r_1^2)} \quad (1)$$

where $B$ is the magnetic flux density;

$r_1$ is the outer radius of the inner conductor;

$r_2$ is the inner radius of the outer conductor;

$v_o$ is the initial velocity of the charge particle;

$V$ is the voltage across the dielectric region, and $c$ is the velocity of light.

When the particle is emitted from the outer conductor (typically when the outer conductor is negative with respect to the inner conductor). The approximate minimum axial magnetic flux density is given in this case by:

$$B \geqq \frac{2r_1}{(r_2^2 - r_1^2)} \left[ \frac{2mV}{|q|} \left( 1 + \frac{|q|V}{2mc^2} \right) \right]^{\frac{1}{2}} - \frac{2mv_0 r_2}{q(r_2^2 - r_1^2)} \quad (2)$$

Since this is generally a smaller value than the value of equation (1) above, this is the preferred minimum value for use in a DC cable system, when the inner conductor is positive with respect to the outer conductor.

Since a smaller magnetic field is usually needed where the inner conductor is positive with respect to the outer conductor, equation (2) represents the preferred arrangement for a DC cable system. In rare circumstances where $r_1$ is almost equal to $r_2$, the situation may be reversed.

Equations (1) and (2) are valid even in the relativistic case, i.e., very high voltages. In the non-relativistic case, $$\frac{qV}{2mc^2} << 1$$

so that this term is negligible in equations (1) and (2). For example, where the charged particles are electrons, neglecting the relativistic term introduces less than a five percent error for voltages less than 100 KV. However, at higher voltages, the relativistic term may be significant.

In the case of real cables and non-vacuum dielectrics under contemplated operating conditions, the situation is sufficiently complex that empirical analysis is recommended for determination of the magnitude of the minimum required magnetic field. A smaller magnitude applied field should generally be required, for example, to provide merely for an improved impulse breakdown voltage level rather than for provision of steady state 60 Hz breakdown voltage level improvement. This is because of the relatively short duration of the impulse voltage. The above equations nonetheless set forth a good approximation of minimum values for an applied magnetic field inhibiting breakdown in the steady state cases for all typical dielectric media.

It is known that the ratio of impulse breakdown voltage to steady state breakdown voltage is least for a vacuum and is increasingly greater for gases, liquids and solids. A significant advantage of a cable constructed in accordance with the present invention is that the applied magnetic field may be utilized to improve this ratio without increasing the size of the transmission cable or reducing the electric field strength.

FIG. 2 illustrates a further embodiment wherein a helical solenoid winding **18*b* is disposed within a hollow core 19 of an inner conductor 12*a*. A magnetic field may be imposed in the region of the dielectric 14 by a current applied through the solenoid winding 18*b*, creating an axial field which adds vectorially with the azimuthal self-magnetic field. It should be noted that where the orientation of the windings 18*b* is the same as the embodiment of FIG. 1 the sense of the applied current must be opposite in order to result in a net field of the same orientation. In this case, the magnetic field in the dielectric 14 may be enhanced if the conductor 12*a*, the conductor 16**, and/or the protective sheath are of high permeability material.

Cables constructed according to the invention may be operated either in the DC or in the AC mode. In the AC or time-varying case, available 60 Hz current may be utilized to produce the applied magnetic field. A small disadvantage exists in the case of FIG. 1, for the application of timevarying current, since the applied alternating field may be slightly attenuated as a result of interaction with the sheath material 17 depending upon its conductivity, permeability and thickness.

A non time-varying imposed magnetic field may be provided by a suitable imposed DC current. The DC field case overcomes some of the problems of attenuation, and losses due to eddy currents and hysteresis. Undesired effects due to the time-varying electric field may result in interaction with DC imposed fields. Care must be taken to assure that his does not result in trapping a cloud of charge. Such conditions may be provided for by suitable choice of magnitude and gradient of the applied axial magnetic field.

Other cable configurations may also provide the desired motion of the charge carriers and suppression of charge multiplication in the dielectric material between the conductors. In FIG. 3, for example, the cable 10, comprising the inner conductor 12 and the outer conductor 16 separated by the dielectric insulative material 14, is enshrouded by spirally disposed magnetic pole means **18*c* each having a North Magnetic Pole face 22 and a South Magnetic Pole face 24, held in position by a suitable material 26. FIG. 4 show more clearly the multipole configuration according to the embodiment of FIG. 3. The flux lines are shown in phantom. The pole means 18*c* may be in a flexible plastic bonded form having the pole directed in radially alternating polarity. In this configuration, a focussing quadrupole helical magnetic field is defined directing charged particles to drift in an axial spiral along the axis of the cable 10, and acting to prevent their traversal of the dielectric gap between the conductors 12 and 16, thereby deterring voltage breakdown. The pole means may conveniently be arranged in a spiral quadrupole or higher multipole such as sextupole, octupole, or an admixture thereof, it being understood that a multipole configuration requires an even number of like pole faces, alternately inwardly and outwardly disposed. Multipoles may be formed by strips of suitable ferromagnetic material having pole faces 22 and 24 oriented radially in an alternating north-south pattern. Although the magnetic pole means 20 has been illustrated as radially surrounding the outer conductor 16, the pole means 20 may also be disposed within the inner conductor 12 in a manner similar to the embodiment of FIG. 2**. Moreover, the combination of inner and outer pole disposition is also within the contemplation of the present invention.

Although the discussion hereinabove has been directed to coaxial cable configurations, the inventive contribution is not limited to coaxial cables. For example, in FIG. 5 a colinear cable according to the invention is illustrated. In this configuration a plurality (herein three) of inner conductors **12*d*, 12*e*, 12*f* are disposed colinearly within the dielectric 12 and the outer conductor 16. A field applying means 18 (herein a solenoid winding) is disposed about the conductors 12 and 16 and dielectric 14. A current applied through the solenoid 18** inhibits the voltage breakdown in the manner as previously described.

Numerous advantages may be realized from the above described invention. The primary advantage is the improvement in the voltage breakdown characteristic without a corresponding increase in the physical size of the transmission cable or reduction of the electric field. In addition, several of the embodiments permit the voltage breakdown characteristic to be readily modifiable in response to differing conditions (in expectation of lightning, for example) without changing the physical dimensions of the cable. Thus, by practice of this invention, cables having a much higher margin of breakdown protection and larger transient-to-steady-state breakdown ratio can be constructed.

Specific embodiments of this invention have been described. In light of this disclosure, many modifications and changes will be obvious to one of ordinary skill in the art which do not depart from the spirit and scope of the invention. Thus, it is not intended that this invention be limited, except as indicated by the appended claims.

What is claimed is:

1. A power transmission line comprising:

a first conductor for carrying power current; a second conductor for carrying power current, said second conductor colinearly surrounding said first conductor; a dielectric insulating region separating said first and second conductors; and means disposed coaxially externally of said second conductor applying a magnetic field colinearly with said first and second conductor for producing a net helical magnetic field having a pitch dependent upon the magnitude of the magnetic field externally applied by said magnetic field applying means and upon the magnitude of the magentic field induced between said first and second conductors by power current.

2. A power transmission cable according to claim 1, wherein said magnetic field inducing means comprises a solenoidal winding operative to carry an electric current.

3. A power transmission cable according to claim 1, wherein said magnetic field inducing means comprises a permanently magnetized medium.

4. A power transmission line according to claim 1, wherein the magnitude of the minimum axial magnetic field applied by said magnetic field applying means in said dielectric region is given by the expression:

$$B \geqq \frac{2r_2}{(r_2^2 - r_1^2)}\left[\frac{2mV}{|q|}\left(1 + \frac{|q|V}{2mc^2}\right)\right]^{\frac{1}{2}} + \frac{2mv_o r_1}{q(r_2^2 - r_1^2)}$$

where

B is the magnetic flux density, $r_1$ is the outer radius of the inner conductor, $r_2$ is the inner radius of the outer conductor, which is significantly larger than $r_1$, $m$ is the mass of a charged particle traversing the distance $r_2$-$r_1$, $q$ is the charge on said charged particle, $c$ is the speed of light, $v_o$ is the initial velocity of said charged particle, and $V$ is the voltage across said dielectric region, and wherein the voltage on the inner conductor may be negative with respect to the outer conductor.

5. A power transmission line according to claim 4, wherein said dielectric region is substantially evacuated.

6. A power transmission line according to claim 1, wherein the magnitude of the axial magnetic field applied by said magnetic field applying means in said dielectric region is given by the expression:

$$B \geqq \frac{2r_1}{(r_2^2 - r_1^2)}\left[\frac{2mV}{|q|}\left(1 + \frac{|q|V}{2mc^2}\right)\right]^{\frac{1}{2}} - \frac{2mv_0 r_2}{q(r_2^2 - r_1^2)}$$

where

B is the magnetic flux density, $r_1$ is the outer radius of the inner conductor, $r_2$ is the inner radius of the outer conductor, which is significantly larger than $r_1$, $m$ is the mass of a charged particle traversing the distance $r_2$-$r_1$, $c$ is the velocity of light, $q$ is the charge on said charged particles, and $V$ is the voltage across said dielectric region;

and wherein the voltage on the inner conductor is positive with respect to the outer conductor.

7. A power transmission line according to claim 6, wherein said dielectric region is substantially evacuated.

8. A power transmission line comprising : a first power current carrying conductor; a second power current carrying conductor colinearly surrounding said first conductor; a dielectric insulative region separating said first and second conductors; and means external of said dielectric region for applying a magnetic field in said region between said first conductor and said second conductor to cause a colinear helical drift of charged particles in said dielectric region impeding voltage breakdown wherein said magnetic field applying means comprises magnetic pole means disposed spirally with respect to the axis of said first conductor.

9. A power transmission line according to claim 8, wherein each said pole means is disposed having pole regions directed in radially alternating polarity.

10. A power transmission line according to claim 8, wherein said pole means comprise an admixture of even multipoles of magnetized strips disposed spirally about the outer circumference of said second conductor.

11. A power transmission line according to claim 10, wherein said pole means comprise an admixture of even multipoles of magnetized strips disposed spirally within the inner circumference of said first conductor.

12. A power transmission line according to claim 8, wherein said pole means comprise an admixture of even multipoles of magnetized strips disposed spirally about the outer circumference of said second conductor and disposed spirally within the inner circumference of said first conductor.

13. A method for improving the voltage breakdown characteristic of a colinear power transmission line having an inner conductor, an outer conductor, and a dielectric region therebetween which comprises applying a magnetic field in the dielectric region along the transmission line which together with the azimuthal self-induced magnetic power current field causes a net colinear helical drift of charged particles in the dielectric region.

14. A method for improving the voltage breakdown characteristic according to claim 13, wherein said magnetic field applying step comprises applying an axial magnetic field, which together with the self-induced azimuthal magnetic field, provides a net helical field whose pitch depends on the relative magnitude of the azimuthal field and the applied axial magnetic field.

15. A method for improving the voltage breakdown characteristic according to claim 13, wherein said magnetic field applying step comprises applying a spiral multipole field coaxial to current-carrying conductors.

16. A method for improving the voltage breakdown characteristic according to claim 13, wherein the cable is coaxial, and wherein said magnetic field applying step comprises applying an axial magnetic field in the dielectric region between the inner conductor and the outer conductor given by the expression:

$$B \geqq \frac{2r_2}{(r_2^2 - r_1^2)} \left[ \frac{2mV}{|q|} \left( 1 + \frac{|q|V}{2mc^2} \right) \right]^{\frac{1}{2}} + \frac{2mv_o r_1}{q(r_2^2 - r_1^2)}$$

where

B is the magnetic flux density, $r_1$ is the outer radius of the inner conductor, $r_2$ is the inner radius of the outer conductor, which is significantly greater than $r_1$, $m$ is the mass of a charged particle traversing the distance $r_2$-$r_1$, $q$ is the charge on said charged particle, $c$ is the velocity of light, $v_o$ is the initial velocity of said charged particle, and $V$ is the voltage across said dielectric region and wherein the voltage on the inner conductor may be negative with respect to the outer conductor.

17. A method for improving the voltage breakdown characteristic according to claim 16, wherein the dielectric region is substantially evacuated.

18. A method for improving the voltage breakdown characteristic according to claim 13, wherein the cable is coaxial, which further comprises maintaining the voltage on the inner conductor positive with respect to the outer conductor and wherein said magnetic field applying step comprises applying an axial magnetic field in the dielectric region given by the expression:

$$B \geqq \frac{2r_1}{(r_2^2 - r_1^2)} \left[ \frac{2mV}{|q|} \left( 1 + \frac{|q|V}{2mc^2} \right) \right]^{\frac{1}{2}} - \frac{2mv_0 r_2}{q(r_2^2 - r_1^2)}$$

$r_1$ is the outer radius of the inner conductor, $r_2$ is the inner radius of the outer conductor, which is significantly greater than $r_1$, $m$ is the mass of a charged particle traversing the distance $r_2$-$r_1$, $c$ is the velocity of light, $q$ is the charge on said charged particle, and $V$ is the voltage across said dielectric region.

19. A method for improving the voltage breakdown characteristic according to claim 18, wherein the dielectric region is substantially evacuated.

* * * * *